United States Patent [19]

Westerlund

[11] 4,089,771

[45] May 16, 1978

[54] ELECTRODE FOR ELECTROLYTIC PROCESS INVOLVING HYDROGEN GENERATION

[75] Inventor: H. Benny Westerlund, Squamish, Canada

[73] Assignee: GOW Enterprises Limited, Vancouver, Canada

[21] Appl. No.: 806,409

[22] Filed: Jun. 14, 1977

Related U.S. Application Data

[63] Continuation-in-part of Ser. No. 788,499, Apr. 18, 1977.

[51] Int. Cl.[2] ..... C25B 11/03; C25B 11/10

[52] U.S. Cl. ..... 204/284; 204/289; 204/290 F; 204/291

[58] Field of Search ..... 204/290 F, 290 R, 289, 204/256, 284, 291

[56] References Cited

U.S. PATENT DOCUMENTS

| | | | |
|---|---|---|---|
| 3,732,157 | 5/1973 | Dewitt | 204/291 X |
| 3,873,437 | 3/1975 | Pulver | 204/284 X |
| 3,919,059 | 11/1975 | Raetzsch et al. | 204/256 X |
| 3,994,798 | 11/1976 | Westerlund | 204/289 X |

*Primary Examiner*—John H. Mack
*Assistant Examiner*—D. R. Valentine
*Attorney, Agent, or Firm*—Millen & White

[57] ABSTRACT

A novel electrode is provided which comprises a porous titanium sheet having a cathode exposed surface which may be untreated titanium or hydrided titanium, and a core of a dense (e.g. expanded) titanium material (e.g. sheet) which is of less porosity or higher density than the surface, the core extending beyond the cathodic surface to provide an anodic member, or a means for connection for current transfer. The cathodic element may include a coating of silver thereon and therein within the pores, or the hydrided surface of the cathode, either as such or one provided with the silver coating may further include a coating of $MoS_2$ thereon and therein within the pores. The exposed cathodic surface of the electrode is of large pore size to enable low cathodic overvoltage. The extending anodic element is coated (e.g. with platinum) to provide the anodic function.

13 Claims, 1 Drawing Figure

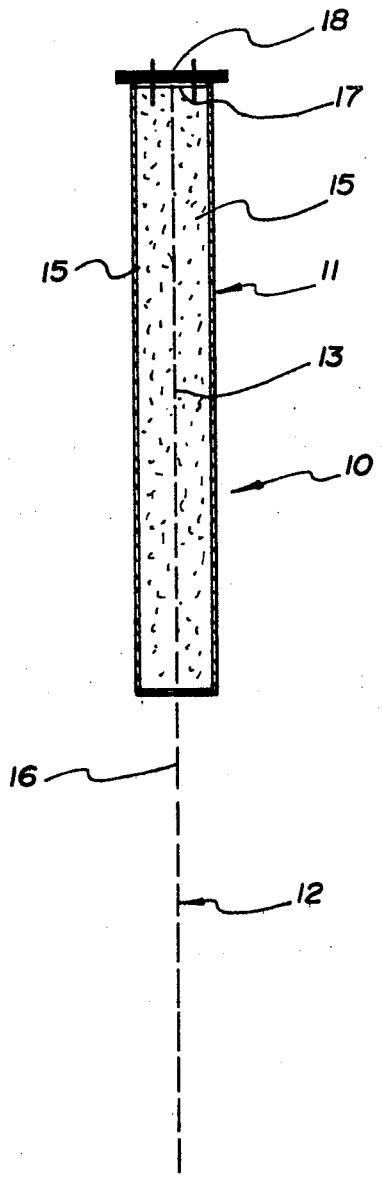
18
17
15
15
11
13
10
16
12

ELECTRODE FOR ELECTROLYTIC PROCESS INVOLVING HYDROGEN GENERATION

RELATED APPLICATIONS

This application is a continuation-in-part of application Ser. No. 788,499 filed Apr. 18, 1977.

BACKGROUND OF THE INVENTION

1. Field of the Invention

This invention relates to electrodes employed in electrolytic cells of the type used for manufacture of products, e.g. chlorates, perchlorates, persulphates and hydroxides. It relates more specifically to electrodes which include a cathode section and an anode section. The electrode of this invention is utilizable for the production of those products which involve generating hydrogen electrochemically on the surface of the cathode.

2. Description of the Prior Art

The cathodes used in early prior art electrochemical technology were, in most cases, of iron or steel. Later on, graphite was used in many electrolytic cell designs employing bipolar electrodes. In more recent years, since 1965, the cathodes employed commercially have mainly been of steel, combined with anodes fabricated from titanium metal which have been specially surface coated. One multi-electrolytic cell, employing such new anodes combined with steel cathodes, is shown in Canadian Pat. No. 914,610 issued to G. O. Westerlund. Another electrolyzer which preferably employs cathodes of steel or other ferrous metal is described in U.S. Pat. No. 3,948,748 issued to Messner et al. Still another, a monopolar type cell, in U.S. Pat. No. 3,598,715 by D. N. Goens, describes a design with cathode assemblies of expanded mild steel. Other cathode materials used in recent technology include the mercury cathode in the electrolytic process of preparing pure hydrogen, in U.S. Pat. No. 3,458,412 issued to Matsuaki Shinagawa et al.

Copending United States application Ser. No. 618,078 filed Sept. 30, 1975, now U.S. Pat. No. 4,053,566, taught that an anode/cathode could be provided from titanium or a titanium alloy. In addition, other metals taught for use as such electrode included tantalum, zirconium and columbium and alloys of such metals. It was taught that, in performing as a cathode, the titanium formed a hydride and consequently some corrosion could occur especially should the electrolyte temperature be excessive (i.e., above about 100° C.) and equalization of electrical potential in the cell under such circumstances would be poor. Another anode/cathode taught in that application was one where the anodes employed were of titanium, which was surface coated with platinum for anode performance. The cathodes employed were of titanium, which was surface coated or treated to improve their cathode performance as cathode surface by the use of a coating of a "suitable cathodic material" (as heretofore defined). For example, titanium sheet of about 1.5 mm thick having a low carbon steel cathode surface was welded and successfully used as the cathode. The coated electrodes could be made using the explosion bonding technique described in Canadian Pat. No. 760,427 issued June 6, 1967 to Ono et al. That application also taught the use of a titanium cathode comprising a grit blasted solid sheet, e.g. the use of a grit of aluminum oxide to increase the surface area and a powdered metal porous sheet. However, prolonged use of these cathodes has shown a tendency of erosion and warpage with resulting risk of electrical short circuiting to the adjacent anode.

An improvement thereon was provided in Canadian Patent application Ser. No. 232,349 filed July 28, 1975. It was taught there that the titanium cathodes could be of the solid sheet, grit blasted type or of the porous or semi-porous fused powdered metal sheet type. Some advantages pointed out for these cathodes were no substantial corrosion; no significant amount of impurities from the cathodes into the electrolyte product; provide for a welded joint for minimum electrical resistance; no cathodic protection hardware required to protect cathodes against corrosion during shut downs; and dimensional stability.

It has been found that while these advantages hold true under ideal conditions, nevertheless the cathode is prone to deteriorate drastically in approximately 1 year's operation, if the conditions are somewhat harsh (i.e. high current density, small spacing, high temperature, high current concentration).

It is also now known that a balancing must be made with respect to pore size. A smaller pore size is desirable for better cathode performance in regard to ohmic resistance. The surface voltage actually is better for the larger pore size. Thus, the cathode should have a small pore size for better conductance of current but a large pore size for improved suface voltage.

It has also been found that, while the cathodes are dimensionally stable if the current distribution is even, in practical application, especially towards the end of an anode life cycle, the current distribution is not uniform over the cathode sheet. This results in warpage which in some cases may be very significant and require a special designed electrode assembly design to prevent electrical short circuiting. Furthermore, in order to re-use the cathode, it may be necessary to heat and press the sheet flat. The powdered titanium cathode, pressed and fused to a porous or semi-porous sheet, is less inclined to warpage since it is likely to be several times the thickness (i.e., in cases where current flows longitudinally through the sheet and voltage drop is maintained the same) compared to the grit blasted titanium sheet cathode.

Moreover, even with solid sheet titanium cathodes there is a tendency to lose thickness after some months' operation due to erosion of the film formed onto the surface of the sheet. This may be very significant after a year of operation.

Copending United States application Ser. No. 788,499 filed Apr. 18, 1977 provided a cathode comprising a porous titanium sheet having a cathodic exposed surface of hydrided titanium, especially wherein the core of the sheet is of less porosity or higher density than the surface. The cathodic electrode so provided included a self-sustaining porous titanium sheet, e.g. powdered titanium which was cast or pressed and sintered into semi-porous or micro-porous form, which was preferably weld-integrated with a current transfer means (e.g. an adjacent anode) and treated at elevated temperature in a hydrogen gas atmosphere to provide an exposed cathodic hydrided titanium surface. The core of the cathode was preferably of high density (i.e., low porosity) for improved current transfer with a surface of larger pore size for low cathode overvoltage.

SUMMARY OF THE INVENTION

Aims of the Invention

The main object of this invention is to provide an electrode which employs titanium as the base metal and which is a combined anode/cathode which, when used in the electrolyzer as cathode, provides acceptable current conductance performance, less overvoltage (or at least equal to) than conventional cathodes, dimensional stability over years of operating with little corrosion and minimizes the corrosive action at the joint to current connector means.

Statement of Invention

This invention provides a titanium material bipolar electrode, the cathodic element of which has a core of dense titanium material and a cathodic surface of powdered, pressed and/or sintered titanium.

Other Features of the Invention

By one feature, the cathodic surface is formed of sintered, pressed, powdered titanium which has been treated for at least partial hydriding.

By another feature, the cathodic surface is formed of sintered, pressed, powdered titanium with a coating of $MoS_2$ thereon and within the pores.

By yet another feature, the hydrided surface of the cathode includes a coating of silver thereon and therein within the pores.

By still another feature, the core of dense material is a sheet of expanded titanium metal.

By yet another feature, the core of dense material is a fine powder of titanium which has been pressed and sintered as a casting or sheeting.

By another feature, the core of dense material extends beyond an end edge of the cathodic element, thereby to provide an anodic element, for providing an end-to-end bipolar electrode.

By still another feature, the core of dense material extends beyond an end edge of the cathodic element, thereby to provide a member for electrical current transfer or connection.

By another feature, the anodic surface may be provided with a coating of a noble metal or an oxide of a noble metal, e.g., platinum.

One edge of the cathode may thus be provided as an integrally extending anode whose surfaces are provided with an anodic coating, thus providing an end-to-end bipolar electrode.

By yet another feature, the cathodic end of the electrode is provided with an electrically non-conductive spacer member.

The electrode of this invention has shown high current efficiency with no conventional chromate additive to the electrolyte, indicating a benefit of employing powdered titanium structure for the cathodic element, especially in the variant of the $MoS_2$ coated cathodic element.

Generalized Description of the Invention

The base material of the electrode is titanium. Titanium is resistant to wear when used in electrolytic cells of the chlorate, perchlorate or chlorine/alkali type. Thus, titanium substantially eliminates maintenance requirements, production disruptions, impurities in the electrolyte (suspended as well as dissolved) and does not require capital investment and operating cost of cathodic protection equipment. However, as a cathode, it will basorb hydrogen to form a hydride, which makes it necessary to consider other than solid titanium as the material for the cathode.

In the electrode of this invention, the anode may be one part of the electrode and the cathode is an integral part of the same electrode. Accordingly, the "connection" between such parts provides low electrical resistance, no significant deterioration with time, and structural strength for handling and use.

The titanium cathodic portion of the electrode should preferably comprise a core of solid or screen type material and with a surface of the powdered sintered type. Special considerations arise because of inherent deficiencies in such materials. Solid and screen type structures of titanium show high hydrogen overvoltage resulting in up to 20% increases in the electric power cost of the product compared to using conventional cathodes for the production. Thus, it is not economically feasible to use those structures as the cathode element without special treatment, as taught by the present invention. A "grit blasted" surface shows lower overvoltage. Nevertheless, a hydride film will develop on the surface. If eroded off, the result will be a deteriorating performance. For long term performance, an improved cathodic element is desired.

Powdered (press-sintered) structures have better overvoltage performance than solid or screen type titanium structures. The powdered structure will hydride the same as the solid structures when used as cathodic elements. The effect is normally not as drastic since due to the lower density these structures would probably have more thickness and rigidity. Although this element is preferred without further treatment due to cost, in time, they will however bow or warp if hydrogen uptake is not evenly over the surface. Loose particles will come off the structure with resulting deteriorating performance. Bowing and warpage can in part be remedied by heat-pressing the structures. This represents an extra cost and does not completely eliminate wear of the cathodes. Powdered structures are very reactive. At elevated temperature, they ignite and react with significant heat generation.

General Description of a Preferred Embodiment

By this invention, an improved structure of powdered (pressed and sintered) titanium is provided which has been treated for improved performance as a cathodic element and for safety reasons as follows: (a) the electrode of powdered titanium is first ignited in an inert and/or non-oxidizing atmosphere to passify the titanium powder for safety in subsequent handling, work and use; and/or (b) the cathodic element of powdered titanium is ignited in a partial or total hydrogen gas atmosphere for passification and for hydrogen uptake onto the surface of the structure with less hydride formation in the core of the structure.

A further improved cathodic element is provided by the step of surface hardening for improved wear rate, i.e., to improve the bond in the structure of the titanium powder and partially hydrided titanium powder by coating with silver.

The cathodic element is still further improved by applying a surface of coating for less cathode reduction reaction losses, by employing a molybdenum sulfide ($MoS_2$) sintered or non-sintered surface coating in the powdered titanium structure, preferably simultaneously in case the coating is to be the sintered type with the hydriding treatment (b). Such cathodic element may be still further improved in bonding structure of the titanium powder and partially hydrided titanium powder as well as improved electrical conductivity of surface and structure by coating with silver.

BRIEF DESCRIPTION OF THE DRAWINGS

In the accompanying drawings, the single FIGURE is a top plan view of an electrode module comprising an end-to-end anodic element and cathodic element and a cell divider means and the means for the assembly of stacked modules in an electrolyzer, according to an embodiment of this invention.

SPECIFIC DESCRIPTION OF THE FIGURE

The FIGURE shows a bipolar electrode of this invention. The bipolar electrode 10 includes a cathodic element 11 and an anodic element 12. The cathodic element 11 includes a central core 13 formed of an expanded titanium sheet, which provides improved longitudinal current conductance. The exposed outer surfaces 15 are of an activated porous titanium nature. The activation may be to provide a hydride surface, either as such or with a molybdenum sulfide coating or substantially simultaneously coated with molybdenum sulfide or coated with silver and with molybdenum sulfide.

The anodic element comprises an extension of the central expanded titanium sheet core 13, and has its titanium surface coated, in any manner known to those skilled in the art, e.g., by a platinum coating, to provide an enhanced anodic surface 16.

The exposed side edge 17 of the cathodic element is provided with an electrode spacer 18. Spacer 18 is formed of any suitable electrically non-conductive plastics material, e.g., polyvinyl dichloride (PVDC), Kynar, Kel-F or Teflon. Such spacer provides, firstly, a division between the cathodic element and a next adjacent anodic element when the bipolar electrode is assembled in an electrolyzer. This controls any current leakage between the cells. The spacer is thus used as a non-conductive stopper when the electrodes are stacked in the electrolyzer. The spacer 18 thus provides an aid for the assembly of electrodes in an electrolyzer.

Test Results of the Electrode

Hydrogen Overvoltage on the Cathodic Element

Powdered titanium structures with 10% hydrogen take-up showed about the same hydrogen overvoltage as a mild steel cathode. A structure with 40% hydrogen take-up showed about 0.1 to 0.3 volt higher overvoltage.

With a silver coating onto the structure which had a 10% hydrogen take-up, the overvoltage did not significantly improve. However, applying a silver coating on the structure with a molybdenum sulfide sintered surface indicated approximately 0.1 volt improvement.

Reduction Losses

The yield of hydrogen in a brine electrolyte containing about 1 gpl sodium hypochlorite and no dichromate was approximately 96% with a molybdenum sulfide sintered coating, less than 93% without a molybdenum sulfide sintered coating and only a slight improvement with a silver coating. $MoS_2$ was coated onto the surface of the powdered sintered titanium and in the pores applied by rubbing fine powdered $MoS_2$ onto the surfaces, or applied by filtering suspended particles of $MoS_2$, or by adding fine particles of $MoS_2$ to the electrolyte and is deposited onto the cathodic element by applied electrical potential. The result was approximately the same as for the variant of the sintered $MoS_2$ coating although the sintered coating provides a harder surface which is more resistant to erosion, especially when the cathodic element is not activated.

Electrical Resistance of Electrodes and Voltage Performances

A powdered titanium electrode used as a bipolar electrode according to this invention of up to 75% porosity and 50 micron powder had a voltage of 0.2 volt lower than a similar electrode having 20% porosity and a 3 micron powder.

Multicell Assembly Electrode Modules

An electrode of the type shown in the drawing which was hydrogen gas treated, performed satisfactorily with or without the spacer element. This spacer element provides for easier stacking of modules in the electrolyzer. An element of the type shown in the drawing, which has not been hydrided, after many months of operating in an electrolytic cell, showed that the titanium was partially hydrided. The electrode performed satisfactorily because of the rigidity of the electrode module when employing the same relative weight of titanium as for a powdered pressed titanium core.

Chlorate Cell Performance

When using cathodes of titanium powder sintered metal, 3 to 50 micron and 20 to 75% porosity, the cathode current efficiency for when higher than 1000 amperes/square meter current density and temperature of brine electrolyte in the range of 40° to 100° C. with no dichromate additive was above 95%. By comparison, using steel or graphite cathodes the reduction loss at the cathode was as high as 15 to 20%.

Hydrogen Gas Treatment

The reaction of hydrogen to powdered titanium is relatively slow, at temperatures below 600° C. Even when retained for more than 1 hour, less than 1% of the titanium is hydrided. At 700° C., the reaction is faster, but it is desirable to bring the temperature in the range of 800° to 1300° C. to achieve fast reaction. The reaction is almost instantaneous when the powdered titanium glows red in colour which occurs above 800° C. Even at the high temperature range, less than 50% of the titanium is hydrided but this appears to be sufficient to achieve the desirable effect when used as a cathode. The hydrogen gas treatment seems to work equally well if the gas is heated and allowed to react with a cold powdered titanium proposed cathode assuming sufficient heat is put to the gas to raise the temperature of the cathode until it is high enough to result in the glow compared to heating the titanium by electrical resistance and starting with cold hydrogen gas atmosphere but heating until the proposed cathode glows.

There are no apparent significant dimensional changes in the electrode after treatment. (If heated in an air atmosphere to the "glow state", the oxidation is rapid and will distort the plate as well as make it extremely brittle. The gas absorption also takes place over a water bath, i.e., part of the electrode may be immersed in the water, thus avoiding hydriding.

Fabrication of Cathodic Elements

Powdered titanium structures include a core of expanded titanium sheet for improved overvoltage. The structure which is to provide the cathodic element is preferably ignited to passify the powder. This can be done by igniting in hydrogen gas or water vapor with hydrogen. The water vapor slows down hydrogen take-up; silver also inhibits take-up. If an $MoS_2$ sintered coating is required, the above ignition process may be combined with sintering of $MoS_2$; the temperature in this case must be above 1200° C. but all heat treatment above 900° C. should preferably be less than 1 minute. $MoS_2$ powder is simply rubbed into the structure. It melts and forms a film at approximately 1185° C. but it is desired to have it sintered rather than a film.

A silver coating is best applied as a secondary treatment, e.g., by means of a paint and heat treatment. Alternatively, a water solution of silver nitrate (or melt at 212° C.) can be applied, heated (450° C.), and decomposed to a silver coating. In decomposing silver nitrate, $NO_2$ is released first and then oxygen, which could violently react with titanium if not properly released, e.g., vacuum may be employed.

With prolonged heat treatment, the titanium powder goes soft (similar to carbon in appearance and feeling). The structure is brittle and loses tensile strength. Consequently, igniting and maintaining the heat input and generation for less than 1 minute at the high temperature is necessary if the best result is to be achieved from electrical conductance, strength and hardness point of view. An overheated structure is usually black all the way through; a structure exposed to high temperature for a few seconds only still has the center core essentially metallic in appearance. It does not seem to be related to the amount of hydrogen take-up but to the length of high temperature duration. It is difficult to define because it would vary with thickness of structure, porosity, and, e.g., moisture content of the structure and the composition of the gas.

$MoS_2$ would wash off if the temperature has been below sintering. It appears to sinter-coat mainly the surface and make the surface significantly harder.

The silver coating is in depth, i.e., it soaks into the pores if applied as a liquid. It surface coats the titanium powder to a light color and improves bond (and hardness) for the structure. If applied before $MoS_2$, it does not appear to give any other significant benefit than somewhat improved electrical conductivity, i.e., not worthwhile pretreatment considering cost.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A titanium material bipolar electrode, the cathodic element of which has a core of dense titanium material, and a pores containing cathodic surface of powdered, pressed, and/or sintered titanium.

2. The electrode of claim 1 wherein said cathodic surface is formed of sintered, pressed, powdered titanium, which has been hydrided.

3. The electrode of claim 1 wherein said cathodic surface is formed of sintered, pressed, powdered titanium and a coating of $MoS_2$ thereon and therein within the pores.

4. The electrode of claim 2 wherein the hydrided surface includes a coating of silver thereon and therein within the pores.

5. The electrode of claim 2 wherein the hydrided surface includes a coating of $MoS_2$ thereon and therein within the pores.

6. The electrode of claim 5 wherein the hydrided surface includes a coating of $MoS_2$ thereon and therein within the pores.

7. The electrode of claim 1 wherein said core of dense material is a sheet of expanded titanium.

8. The electrode of claim 1 wherein said core of dense material is fine powdered titanium which has been pressed and sintered as a casting or sheet.

9. The electrode of claim 1 wherein said core of dense material extends beyond an end of said cathodic element, thereby to provide an anodic element, for providing an end-to-end bipolar electrode.

10. The electrode of claim 1 wherein said core of dense material extends beyond an end of said cathodic element, thereby to provide a member for electrical current transfer or connection.

11. The electrode of claim 9 wherein said anodic coating is of a noble metal or an oxide of a noble metal.

12. The electrode of claim 1 wherein the exposed edge face of the cathodic element is provided with an electrically non-conductive electrode spacer.

13. The electrode of claim 12 wherein said electrode spacer is formed of a synthetic plastics material.

* * * * *